United States Patent [19]

Kellogg

[11] 4,121,801

[45] Oct. 24, 1978

[54] SHELF BRACKET

[76] Inventor: Harlan F. Kellogg, 1611 Sprucewood, Rockford, Ill. 61107

[21] Appl. No.: 833,252

[22] Filed: Sep. 12, 1977

[51] Int. Cl.[2] ..... A47G 29/02

[52] U.S. Cl. ..... 248/235; 108/152

[58] Field of Search ..... 248/235, 241, 243, 250, 248/222.4, 239; 108/152

[56] References Cited

U.S. PATENT DOCUMENTS

| | | | |
|---|---|---|---|
| 2,772,846 | 12/1956 | Skar | 248/243 |
| 3,190,243 | 6/1965 | Pira | 108/152 |
| 3,265,344 | 8/1966 | Ornstein | 108/152 |
| 3,295,474 | 1/1967 | Ornstein | 248/243 |
| 3,432,134 | 3/1969 | Forschmidt | 248/235 |
| 3,672,624 | 6/1972 | Keller | 108/152 |
| 3,704,675 | 12/1972 | Bellasalma | 108/152 |
| 3,837,605 | 9/1974 | Sicard | 248/235 |

FOREIGN PATENT DOCUMENTS

| | | | |
|---|---|---|---|
| 231,650 | 2/1964 | Fed. Rep. of Germany | 248/243 |
| 154,129 | 4/1956 | Sweden | 248/243 |
| 1,170,906 | 11/1969 | United Kingdom | 248/243 |

*Primary Examiner*—Robert A. Hafer

*Attorney, Agent, or Firm*—Morsbach & Pillote

[57] ABSTRACT

A shelf bracket including a bracket member formed of non-metallic material and having an upper shelf supporting surface and a rear abutment surface and a generally L-shaped metal attaching member for mounting the shelf bracket member on a supporting surface. The non-metallic bracket member has recesses at the upper rear corner thereof for receiving the metal attaching member and the bracket member has a downwardly extending notch in its upper surface for receiving a downwardly extending tongue on the metal attaching member to horizontally anchor the bracket member adjacent its upper surface. A second anchor extends horizontally from the lower portion of the attaching member into the bracket member to vertically support the bracket member.

9 Claims, 4 Drawing Figures

Fig. 1.
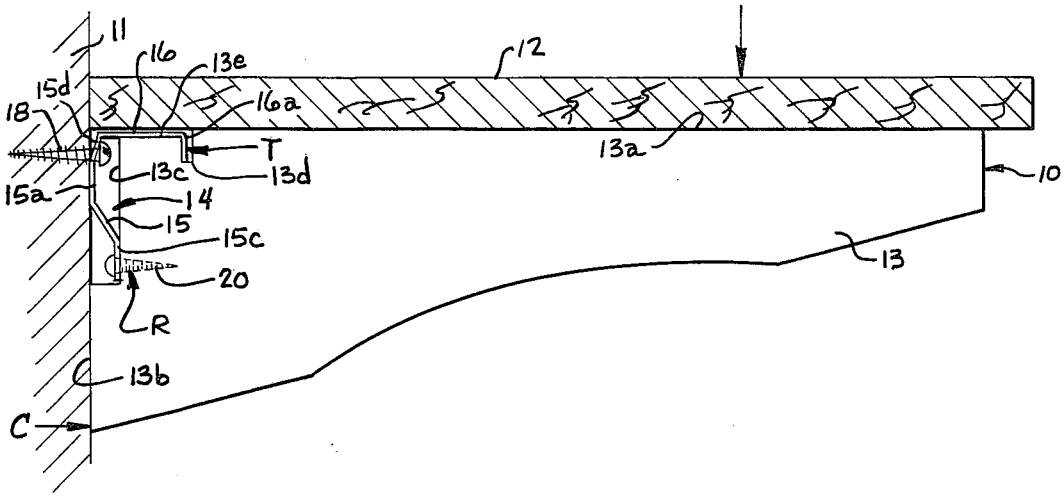
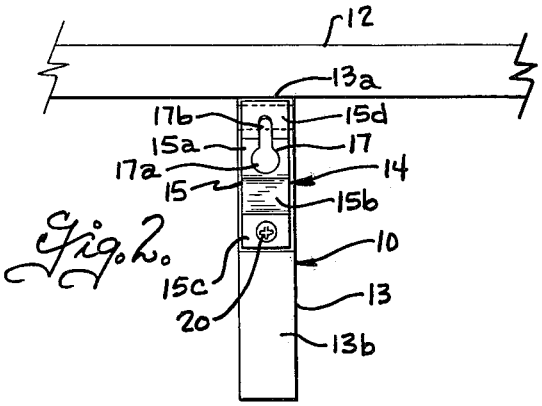
Fig. 2.
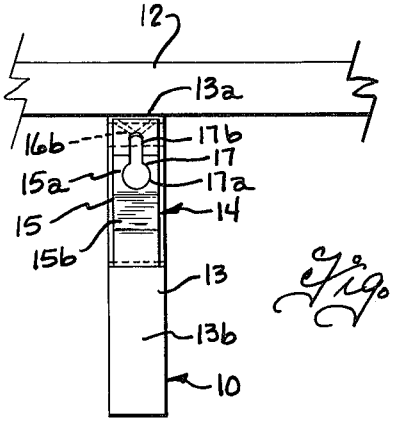
Fig. 4.
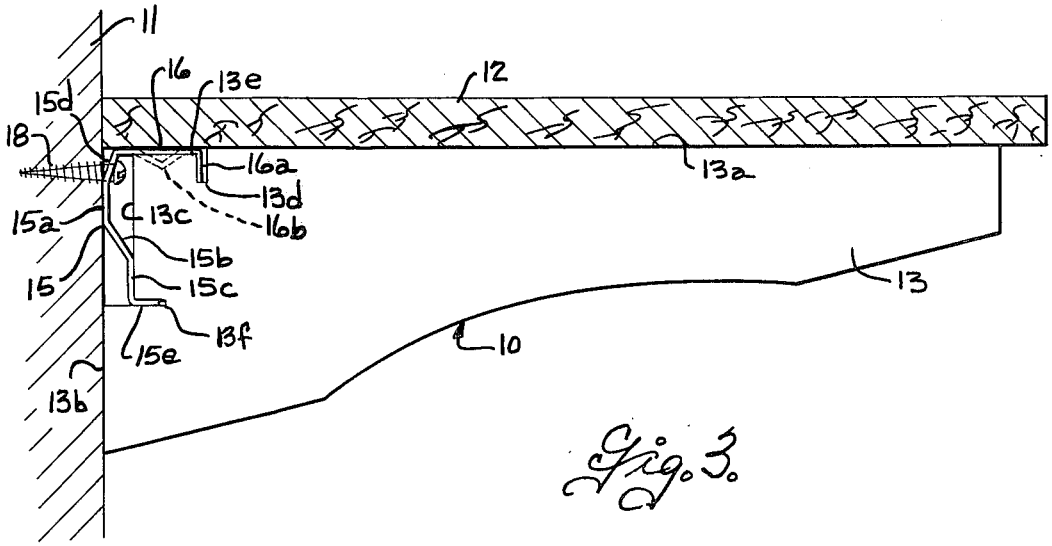
Fig. 3.

SHELF BRACKET

BACKGROUND OF THE INVENTION

The present invention relates to shelf brackets of the type which are adapted for mounting at the rear end thereof on an upright supporting surface to extend in generally cantilever fashion from the supporting surface. It is common practice to make shelf brackets of this type with an all metal construction in which the shelf brackets have integral lugs or hooks at the rear ends for engaging in openings in upright mounting standards. However, it is sometimes desirable to make the shelf brackets of a non-metallic material such as wood, wood particle board or plastic. In order to mount such shelf brackets of non-metallic material, it has heretofore been proposed, for example as shown in U.S. Pat. Nos. 3,190,243; 3,265,344 and 3,295,474 to provide a metal attaching member at the rear of the shelf brackets and to secure the metal attaching member to the shelf brackets as by screws that extend horizontally into the ends of the shelf brackets. When a downward load is applied to the shelf brackets, the bracket tends to fulcrum about its lower rear edge and the upper portion of the bracket tends to pull away from the supporting surface and withdraw the screws out of the shelf bracket. The holding power of screws in many non-metallic materials, for example in the end grain of many woods, wood particle board, and many plastics is not sufficiently high that it can be safely relied upon to withstand such withdrawal forces. It has also been proposed, as shown in U.S. Pat. No. 3,432,134, to provide a U-shaped metal attaching member for mounting the non-metallic shelf bracket on a support surface with the U-shaped attaching member overlapping opposite sides of the shelf bracket and with the fasteners extending crosswise of the bracket. Such a metal attaching member is more complex and expensive to manufacture and, moreover, is exposed at the sides of the shelf bracket and consequently adversely affects the aesthetic appearance of the shelf bracket. It has also been been proposed, as shown in U.S. Pat. No. 3,672,624, to attach a non-metallic shelf bracket to a support using a metal hook that extends into a downwardly and rearwardly inclined opening in the top of the shelf bracket. With this arrangement, the downwardly and rearwardly extending hook must take both of horizontal separating forces between the bracket member and the support as well as the vertical load on the bracket member. Moreover, because of the manner in which the metal attaching member is mounted on the shelf bracket, the metal attaching member must have its wall mounting portion disposed above the top of the shelf bracket, as shown in that patent.

SUMMARY OF THE INVENTION

These problems of the prior art are overcome by the present invention which provides an improved arrangement for interconnecting a shelf bracket and an attaching member which can withstand heavy loads on the shelf bracket; in which the metal attaching member is disposed in recessed areas at the rear portion of the shelf bracket as to be substantially concealed when the shelf bracket is in use; and in which the shelf bracket and shelf bracket attaching member can be easily and economically formed and assembled.

Accordingly, the present invention provides a shelf bracket member having a top shelf supporting surface and a rear abutment surface extending perpendicular to the shelf supporting surface adjacent the lower rear portion of the shelf bracket member, the shelf bracket member having a rear recessed surface above and offset forwardly from the rear abutment surface and the shelf bracket having a notch extending downwardly from the top shelf supporting surface and spaced forwardly from the rear recessed surface, and the shelf attaching member has a generally L-shaped configuration and includes a rear leg having an upper mounting plate portion spaced rearwardly from the rear recessed surface with a key hole shaped opening therein, and an upper leg extending forwardly from the upper end of the rear leg and overlying the top recessed surface, the attaching member having a depending tongue at its forward end extending into a notch in the top of the bracket member to take up the horizontal forces, and an anchor adjacent the lower end of the rear leg that extends forwardly into the shelf bracket to take up the vertical loading on the bracket member.

These, together with other objects, features and advantages of the present invention will be more readily understood by reference to the following detailed description when taken in connection with the accompanying drawings wherein:

FIG. 1 is a vertically sectional view through a shelf assembly embodying the present invention;

FIG. 2 is a rear elevational view of the shelf bracket shown in FIG. 1;

FIG. 3 is a sectional view through a shelf assembly illustrating a modified form of shelf bracket; and FIG. 4 is a rear elevational view of the shelf bracket of FIG. 3.

The shelf bracket assembly designated by the numeral 10 is adapted for attachment to an upright surface such as a wall 11 to extend therefrom in cantilever fashion for supporting a shelf 12. The shelf assembly includes a shelf bracket member 13, conveniently formed of non-metallic material such as wood or wood particle board, and a metal shelf bracket attaching member 14 connected to the shelf bracket member 13 adjacent the rear end thereof. The shelf bracket member 13 has a top shelf supporting surface **13*a* which extends generally horizontally, and a rear abutment surface 13*b* which extends perpendicular to the top shelf supporting surface and is located adjacent the lower rear portion of the bracket member. The bracket member also has a rear recessed surface 13*c* located above and offset forwardly from the rear abutment surface 13*b*. The shelf bracket member 13 also has a notch 13*d* extending downwardly from the top shelf supporting surface 13*a* adjacent the rear end thereof and spaced forwardly from the rear recessed surface 13*c*, and a top recessed surface 13*e*** that extends rearwardly from the notch and is offset below the top shelf supporting surface.

The metal attaching member 14 is disposed in the recessed areas at the rear end of the bracket and has a generally L-shaped configuration including a rear leg 15 and an upper leg 16 extending forwardly from the upper end of the rear leg. The rear leg 15 has a key hole shaped opening 17 therein (FIG. 2) for receiving a fastener such as a screw 18 for attaching the bracket assembly 10 to the upright supporting surface or wall 11. The upper leg 16 of the attaching member extends forwardly in overlying relation with the upper recessed surface **13*e* on the bracket member and has a depending tongue 16*a* at its forward end that extends downwardly into the notch 13*d*. The rear leg 15 of the attaching member has a mounting plate portion 15*a* that is spaced from the tongue 16***a* a distance such that the mounting plate portion is spaced rearwardly from the recessed surface 13*c* on the bracket member and is preferably substantially coplanar with the rear abutment surface 13*b*. The rear leg has a portion 15*b* that extends downwardly and forwardly and terminates adjacent its lower end in a portion 15*c* that is offset forwardly from the mounting plate portion to engage the rear recessed surface 13*c* and space the mounting plate portion 15*a* from the rear recessed surface 13*c*. The rear leg also has an upper cam portion 15*d* that extends upwardly and forwardly from the mounting plate portion. As best shown in FIG. 2, the key hole shaped opening 17 has its eye portion 17*a* located in the mounting plate portion 15*a* and its slot portion 17*b* extends upwardly into the cam portion 15*d* of the rear leg. With this arrangement, the head on the fastener 18 engages the cam portion as the bracket assembly is pressed downwardly to cam the bracket assembly rearwardly toward the wall 11.

The lower end of the metal attaching member 14 is connected to the non-metallic bracket member 13 in a manner to take up the vertical loads on the shelf bracket. In the embodiment of FIGS. 1 and 2, an anchor in the form of a screw 20 extends through an opening in the lower offset portion 15*c* and is threaded into the non-metallic shelf bracket member 13.

In the modified form shown in FIGS. 3 and 4, the bracket member 13 and attaching member 14 are substantially the same and like numerals are used to designate corresponding parts. However, in the latter embodiment, the shelf bracket member has a generally horizontally extending notch 13*f* that extends forwardly from the rear recessed surface 13*c*, and the attaching member has a forwardly extending tongue 15*e* at its lower end that extends forwardly into the notch 13*f*, to take up the vertical loads on the shelf bracket. In order to inhibit relative movement between the attaching member 14 and the bracket member 13 in a direction crosswise of the latter, the upper leg 16 is upset or formed with a depression 16*b*, as by a punch, after the attaching member is assembled on the bracket member, to inhibit movement of the attaching member in a direction crosswise of the shelf bracket member.

From the foregoing it is thought that the construction and operation of the shelf bracket assembly will be readily understood. The shelf bracket member 13 can be formed with various shapes for aesthetic purposes and the recesses 13*c*, 13*e* and notches 13*d* and 13*f* can be easily formed in the non-metallic bracket members as by sawing or rabbeting. The metal attaching member is formed of strap stock and can be easily punched to form key hole and bent into the generally L-shaped configuration with integral tongues. When the attaching member is assembled on the non-metallic shelf bracket 13, the depending tongue 16*a* takes up the horizontal forces which tend to pull the shelf bracket away from the wall and the anchor comprising either the screw 18 in the embodiment of FIGS. 1 and 2 or the horizontal tongue 15*e* in the embodiment of FIGS. 3 and 4, takes up the vertical loading on the bracket assembly. More particularly, when a load indicated by the arrow W in FIG. 1 is applied to a shelf assembly at a location spaced from the wall, the shelf bracket 13 is forced downwardly and is also subjected to a turning moment which tends to press the rear abutment surface 13*b* against the wall and to pull the upper rear edge away from the wall. This turning moment on the shelf bracket assembly is opposed by a horizontal force couple including a generally horizontal force component indicated by arrow C applied to the rear abutment surface 15*b* on the bracket member, and an opposing generally horizontal force component indicated by the arrow T applied by the tongue 16*a* of the attaching member to the upper portion of the bracket member. The downward load W is opposed by a vertical reaction force component indicated by the arrow R applied by the anchor means that connects the lower end of the attaching member to the shelf bracket member. This anchor means is the form of a screw 18 in the embodiment of FIGS. 1 and 2 and in the form of a generally horizontal tongue 15*e* in the embodiments of FIGS. 3 and 4. Since the tongue 16*a* on the metal attaching member 14 engages the bracket member 13 adjacent the top of the bracket member and at a location adjacent the level of the mounting screw 18, the tongue 16*a* takes up the horizontal force component T which tends to separate the top of the bracket member from the wall and there is accordingly substantially no horizontal force applied to the anchor means. Thus, the screw 18 in the embodiment of FIGS. 1 and 2 is subjected primarily to the vertical reaction force component R and is not subject to substantial tension which could cause the screw to strip from the bracket member. Similarly, in the embodiment of FIGS. 3 and 4, the horizontal tongue 15*e* is subject primarily to vertical loading and not to substantial horizontal forces.

The embodiments of the invention in which an exclusive property or privilege is claimed are defined as follows:

1. A shelf bracket adapted for mounting at the rear end thereof on an upright surface comprising, an elongated shelf bracket member having a top shelf supporting surface and a rear abutment surface extending perpendicular to the top shelf supporting surface adjacent the lower rear portion of the shelf bracket member, said shelf bracket member having a rear recessed surface above and offset forwardly from said rear abutment surface, said shelf bracket member having a notch extending downwardly from the top shelf supporting surface and spaced forwardly from said rear recessed surface, and a generally L-shaped shelf bracket attaching member including a rear leg and an upper leg, the rear leg having an upper mounting plate portion spaced rearwardly from said rear recessed surface and a keyhole shaped opening in said upper mounting plate portion for receiving a headed mounting fastener, said upper leg extending forwardly from the upper end of the rear leg in overlying relation to the bracket member and having a depending tongue at its forward end extending into the notch in the shelf bracket member, and anchor means adjacent the lower end of said rear leg extending forwardly into the shelf bracket member.

2. A shelf bracket according to claim 1 wherein said shelf bracket member has a top recessed surface extending rearwardly from said notch and offset below the top shelf supporting surface, said upper leg of said attaching member overlying said top recessed surface.

3. A shelf bracket according to claim 1 wherein said anchor means comprises a screw.

4. A shelf bracket according to claim 1 wherein said shelf bracket member has a second notch extending forwardly from said rear recessed surface and spaced below said top recessed surface, said anchor means including a second tongue on the lower end of said rear leg extending forwardly into said second notch.

5. A shelf bracket according to claim 1 wherein the lower portion of said rear leg is offset forwardly of the upper mounting plate portion thereof to engage said rear recessed surface and space the upper mounting plate portion from said rear recessed surface.

6. A shelf bracket according to claim 5 wherein said upper mounting plate portion of said rear leg has a generally upright portion disposed generally coplanar with the rear abutment surface on the shelf bracket member and a cam portion extending upwardly and forwardly from said generally upright portion, the slot of the key hole shaped opening extending into said cam portion.

7. A shelf bracket according to claim 6 wherein said anchor means comprises a screw extending through said lower portion of the rear leg into said shelf bracket member.

8. A shelf bracket according to claim 6 wherein said shelf bracket member has a second notch extending forwardly from said rear recessed surface and spaced below said top recessed surface, said anchor means including a second tongue on the lower end of said rear leg extending forwardly into said second notch.

9. A shelf bracket according to claim 1 wherein said bracket attaching member is formed from a flat strap.

* * * * *